United States Patent [19]

Reuchlein et al.

[11] Patent Number: 4,856,165

[45] Date of Patent: Aug. 15, 1989

[54] METHOD FOR PRODUCING BY WELDING A FINNED HEAT EXCHANGER PIPE

[75] Inventors: Günter Reuchlein; Gerhard Schiessl, both of Augsburg, Fed. Rep. of Germany

[73] Assignee: Man Technologie GmbH, Munich, Fed. Rep. of Germany

[21] Appl. No.: 249,387

[22] Filed: Sep. 26, 1988

[30] Foreign Application Priority Data

Oct. 1, 1987 [DE] Fed. Rep. of Germany ..... 3733155

[51] Int. Cl.[4] ..... B21D 53/06

[52] U.S. Cl. ..... 29/157.3 A; 29/157.3 R; 29/157.3 H; 165/181

[58] Field of Search ..... 29/157.3 A, 157.3 AH, 29/157.3 C, 157.3 H, 447; 165/181

[56] References Cited

U.S. PATENT DOCUMENTS 1,943,557 1/1934 Ruthenburg et al. ..... 165/181

3,189,087 6/1965 Parris ..... 29/157.3 A X 3,216,095 11/1965 Kurtz et al. ..... 29/157.3 A

*Primary Examiner*—Mark Rosenbaum

*Assistant Examiner*—Peter D. B. Vo

*Attorney, Agent, or Firm*—Frishauf, Holtz, Goodman & Woodward

[57] ABSTRACT

The invention provides a method for the production by welding of a heat exchanger pipe starting with a round metallic pipe onto which external metallic fins are secured so as to be perpendicular to the axis of the pipe. Each metallic fin is produced in two halves in such a manner each fin has a coxial semicircular recess or bay whose radius mateches the external diameter of the metallic pipe and on each side of such recess there are two side surfaces so that after mounting the fin halves on the pipe there is a small gap at the parting line between the two halves. After mounting the two fin halves on the metallic pipe the respectively radially outer and parts of the gap are spot welded together and on cooling down the fin the fins shrinkage at the weld spots causes the two fin halves to pressed on the pipe with their recess boundaries engaging the outer surface of the pipe.

14 Claims, 1 Drawing Sheet

METHOD FOR PRODUCING BY WELDING A FINNED HEAT EXCHANGER PIPE

The invention relates to a method for the production of a finned heat exchanger pipe, starting with a round metallic pipe, having external metallic fins thereon extending transversely in relation to the axis of the pipe.

BACKGROUND

For the production of finned heat exchanger pipes a number of different methods have been available, in which for instance the fin contact with the pipe is produced by a press fit, by welding or by brazing. A regular, predictable transfer of heat is however only possible if there is a welded or brazed joint between the fins and the metallic pipe. Welding on the fins to the metallic pipe however will mean that when the pipe is in operation it is subjected to high notch stresses. This prevents the use of such a pipe in certain applications where there is risk of fracture. The brazing on of the fins to the metallic pipe has proved to be the most apt method of attachment for heat exchanger pipes which are subject to high thermal and mechanical loads. The fins have to be held in the correct position during the brazing operation on the metallic pipe especially in the case of brazing in high vacuum, very elaborate holding devices have to be used which are not wetted by the spelter, as for instance ceramic and like materials. The welding of long finned heat exchanger pipes with fins placed close to each other has thus not been economically possible.

SHORT SUMMARY OF THE INVENTION

Thus one object of the invention is to provide a method for the production of a heat exchanger pipe of the initially mentioned type in the case of which the fins are able to be secured to in relation to the metallic pipe excactly in relation thereto a simple manner prior to and during their attachment to the pipe.

Briefly, the method is so performed that each metallic fin is produced in two halves, of which each has a coaxial semicircular recess with a a radius adapted to the external diameter of the metallic pipe and in each case on both sides of the recess. The half has two side surfaces so that after mounting the two fin halves on the metallic pipe a narrow gap remains adjacent to the parting line and after mounting on the metallic pipe the two halves of a fin are spot welded together at the respectively radially outer end part of the gap. during cooling down, the shrinkage of the spot welds causes a reduction in the width of the gap and a pressing of the two fin halves onto the said metallic pipe with their recesses fitting onto the pipe. As a consequence of this method the two fins halves welded together in this manner are then frictionally engaged at the boundaries of the recesses with the periphery of the metallic pipe as a prefixed fin. Any brazing on operation which is then required may then take place without the use of a holding means for the fins.

A detailed account will now be given of one working example of the method in accordance with the invention with reference to the drawings.

DETAILED DESCRIPTION OF THE DRAWINGS

Figure 1:
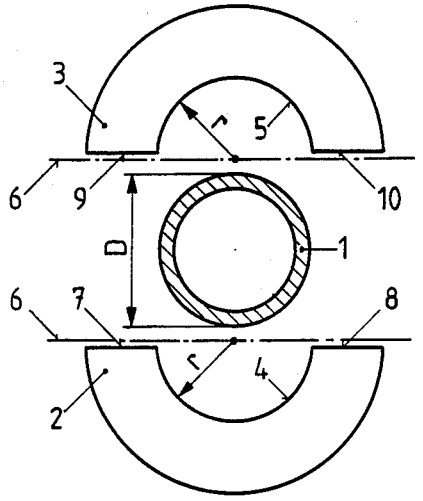
FIG. 1 is a view of the metallic pipe and the two halves of a fin prior to fitting them together.
Figure 2:
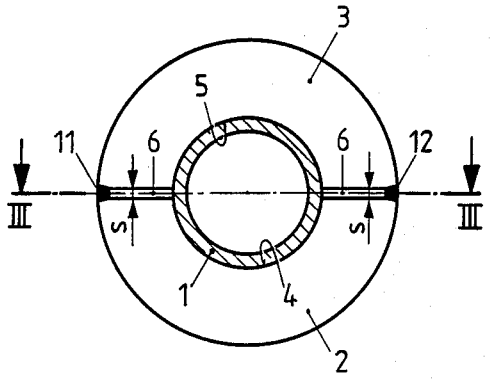
FIG. 2 shows a cross section of the heat exchanger pipe after securing the fin halves to the metallic pipe.
Figure 3:
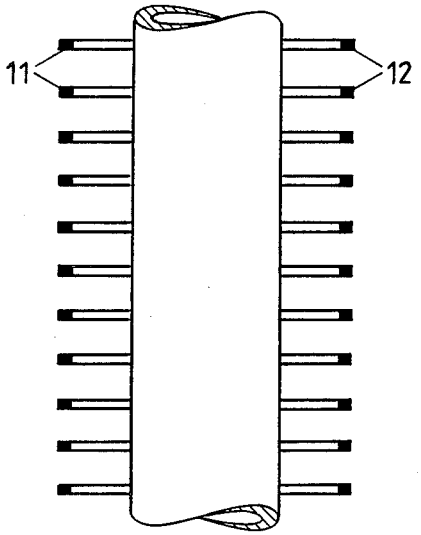
FIG. 3 is a section taken on the line III—III as shown in FIG. 2.

The heat exchanger pipe is produced starting from a metallic pipe 1 and a plurality of metallic fins or ribs. The metallic pipe 1 had a cross section corresponding to a circular ring and has an external diameter D.

In accordance with the invention each metallic fin is produced from two halves 2 and 3 in such a manner that each is made with a coaxial, semicircular recess or bay 4 and 5, respectively, with a radius r adapted to match the external diameter D of the metallic pipe and side surfaces 7, 8 and, respectively, 9 and 10 extending essentially parallel to the center or parting line 6 on either side of the recess. These side surfaces 7, 8 and, respectively, 9 and 10 are so far spaced from the respective middle or parting line 6 that a narrow gap s is left between two adjacent side surfaces 7 and 9 and, respectively, 8 and 10 of the same after mounting the two halves 2 and 3 of a fin on the metallic pipe 1. Dependent on the diameter of the metallic pipe 1 this gap s amounts to between 0.05 and 1 mm, the gap being larger with an increase in the size of the pipe.

The radius 4 of the recess 4 and, respectively, 5 in each of the two fin halves 2 and, respectively, 3 is the same or, preferably, a few hundredths to a few tenths of millimeter larger than the radius (D/2) of the metallic pipe.

After mounting the two halves 2 and, respectively, 3 of a fin on the metallic pipe 1 they are welded together at the radially outer end parts of the gap s in such a manner that there is no undercut, i.e. no undercutting of the pipe surface due to welding. The welding is performed by running an automatic welder, or a roller seam welding device, over the welding zones of a plurality of fin halves which have been preliminarily fixed to the metallic pipe 1. The weld spots 11 and 12 shrink as they cool, with the consequence that there is reduction of the gaps. The two halves 2 and 3, respectively, are pressed against the metallic pipe at both sides of the recesses 4 and 5, respectively. As a result the two halves are joined together at the weld spots and frictionally locked on the outside of the metallic pipe 1.

For any subsequent brazing of the fins on the metallic pipe 1 it is not necessary to employ any holding means during such brazing operation. Such brazing onto the metallic pipe 1 will prove necessary if the finned heat exchanger pipe is to be subject to very high mechanical and thermal loads, that is to say comes within a category of pipes used for high pressure fluids with a high pressure and externally exposed to a fluid with a temperature of up to 2000° C., for instance, and subject to a high temperature differential $\Delta T$ of up to 1000° C. In the case of such heat exchanger pipes the brazing of the two halves 2 and 3 of each fin to the metallic pipe 1 may be performed in a single working step, the spelter or brazing material being preferably in the form of a strip of spelter paste placed on the respective spot welds 11 and 12 of a plurality of fins placed in axial succession along the metallic pipe 1. When the brazing temperature is reached the spelter is drawn into the gap by capillary action to each the surfaces which are then contiguous to the brazed joint.

The method in accordance with the invention is found to be especially suitable for the manufacture of heat exchanger pipes in large production runs. In this case for the connection together of the two halves 1 and 3, respectively, of fin it is sufficient to have only a comparatively small holding welding spot 11 and 12 respectively on the two opposite sides of the gap in order to shrink a fin onto the metallic pipe in a positioning jig. Even if there is only a small distance between the inner periphery of the fin from the metallic pipe 1 during welding, no undercutting will occur on the metallic pipe so that there is thus no notching. Furthermore any brazing of the fins on of the fins may take place in a simple and still reliable manner.

The method in accordance with the invention leads to heat exchanger pipes which with stand loads in operation without any risk of fracture.

We claim:

1. A method of producing a heat exchanger pipe starting with a metallic pipe (1) of circular cross section and metallic fins (2, 3), comprising the steps of producing said fin in two halves (2,3) formed with semicircular recesses (4,5) which have a radius (r) adapted to the external diameter (D) of the metallic pipe, said fin recess being flanked by two side surfaces (7,8,9,10), placing the fin halves on said pipe (1) so as to straddle same and leaving a narrow gap(s) at a parting line between said fins, wherein the gap has a size range of 0.05 mm to 1 mm positively correlated with the diameter of the metallic pipe, producing weld spots (11,12) to connect the two halves of such fin at radially outer end parts of the gap, and cooling the weld spots so that the gap is reduced in size and the fin halves are pressed by shrinkage due to cooling of said fin halves onto the metallic pipe at the boundaries of their recesses.

2. The method as claimed in claim 1 wherein the radius of the recesses in the two respectively fin halves is slightly larger than the radius of the metallic pipe for fitting of the fin halves onto the pipe by shrinkage.

3. The method as claimed in claim 1 wherein the step of producing the weld spots comprises moving an automatic welder along welding zones in a straight line on the halves of plurality of fins arranged in axially spaced out succession on the metallic pipe.

4. The method as claimed in claim 1 wherein the fin halves are arranged in axially spaced succession on the metallic pipe and the welding of the fin halves is performed by moving a rolled seam welding device along the weld zones, arranged in a straight line.

5. The method as claimed in claim 1 wherein said step of cooling the weld spots so that the gap is reduced also comprises positioning the fin halves on the metallic pipe;

said method including the further step of brazing the so-positioned fin halves on the metallic pipe.

6. The method as claimed in claim 5 including the step of:

applying a strip of spelter paste along the narrow gaps of the plurality of fins after said fins have been located on the pipe;

and heating said spelter to brazing temperature to draw the melting spelter into the gaps and form, by capillary action, continuous brazed joints.

7. A method of producing a heat exchanger pipe starting with a metallic pipe of round cross section and metallic fins comprising the steps of producing each such fin in two halves (2,3) formed with semicircular recesses (4,5) which have a radius (2) adapted to the external diameter (D) of the metallic pipe, each such fin recess being flanked by two side surfaces (7,8,9,10), placing the fin halves on such pipe (1) so as to straddle same and leaving a narrow gap at a parting line between such fins, producing weld spots (11,12) to connect the two halves of such fin at radially outer end parts of the gap, and cooling the weld spots so that the gap is reduced in size and the fin halves are pressed onto the metallic pipe at the boundaries of their recesses;

said method including the further step of brazing the so positioned fin halves on the metallic pipe.

8. The method of claim 7 wherein the radius of the recesses in the two respectively fin halves is slightly larger than the radius of the metallic pipe for fitting of the fin halves onto the pipe by shrinkage.

9. The method of claim 7 wherein the step of producing the weld spots comprises moving an automatic welder along welding zones in a straight line on the halves of plurality of fins arranged in axially spaced out succession on the metallic pipe.

10. The method of claim 7 wherein the fin halves are arranged in axially spaced succession on the metallic pipe and the welding of the fin halves is performed by moving a rolled seam welding device along the weld zones, arranged in a straight line.

11. The method as claimed in claim 7 including the step of:

applying a strip of spelter paste along the gaps of the plurality of fins after said fins have been located on the pipe.

12. The method of claim 11 wherein the radius of the recesses in the two respectively fin halves is slightly larger than the radius of the metallic pipe for fitting of the fin halves onto the pipe by shrinkage.

13. The method of claim 11 wherein the step of producing the weld spots comprises moving an automatic welder along welding zones in a straight line on the halves of plurality of fins arranged in axially spaced out succession on the metallic pipe.

14. The method of claim 11 wherein the fin halves are arranged in axially spaced succession on the metallic pipe and the welding of the fin halves is performed by moving a rolled seam welding device along the weld zones, arranged in a straight line.

* * * * *